United States Patent [19]

Yuda et al.

[11] 4,248,470

[45] Feb. 3, 1981

[54] BOTTLE CARRIER

[75] Inventors: Takuo Yuda, Yokohama; Toshie Tanaka, Machida; Koji Watanabe, Fujisawa, all of Japan

[73] Assignee: Nifco Inc., Yokohama, Japan

[21] Appl. No.: 110,963

[22] Filed: Jan. 10, 1980

[30] Foreign Application Priority Data

Jan. 12, 1979 [JP] Japan ..... 54/1111[U]

[51] Int. Cl.[3] ..... B65D 71/00

[52] U.S. Cl. ..... 294/87.2; 206/151; 224/45 A

[58] Field of Search ..... 294/87.2, 87 R, 87.24, 294/87.22, 87.28; 206/150, 151; 224/45 A, 45 AA, 45 AB, 45 BA

[56] References Cited

U.S. PATENT DOCUMENTS

| | | | |
|---|---|---|---|
| 3,309,545 | 1/1973 | Oltmanns | 294/87.2 |
| 3,713,684 | 1/1973 | Poupitch | 294/87.2 |
| 4,063,771 | 12/1977 | Calvert | 294/87.2 |
| 4,093,295 | 6/1978 | Erickson | 294/87.2 |
| 4,159,841 | 7/1979 | Calvert | 294/87.2 |

*Primary Examiner*—James B. Marbert
*Attorney, Agent, or Firm*—Thomas L. Buckman

[57] ABSTRACT

A bottle carrier comprising a main carrier body substantially of the shape of a plate, retaining parts each formed of a pair of opposed arms and extended outwardly from the corners of the longitudinal edges of the main carrier body, legs extended from the opposite longitudinal edges of the main carrier body and allowed to thrust out through spaces intervening between the leading ends of the respective arms, and separators formed one each at the tips of the legs, with all the aforementioned component parts formed within one substantially flat plate, the arms having the respective leading portions thereof bent arcuately in the backward direction to form engaging pieces, the legs having the respective basal portions thereof formed in a decreased wall thickness to give rise to hinge portions, whereby the barrel portions of bottles are brought into contact with the separators and the neck portions of the bottles are wrapped by the arms and fastened by the engaging pieces so as to bind the bottles to each other.

1 Claim, 6 Drawing Figures

BOTTLE CARRIER

BACKGROUND OF THE INVENTION

This invention relates to a bottle carrier formed of a plastic material in a construction such as to support two bottles by their necks and enable them to be carried as held parallelly to each other and, at the same time, prevented from directly colliding with and consequently inflicting breakage upon each other.

Bottle carriers adapted to hold in position a plurality of bottles by their necks and permit the bottles to be carried as suspended therefrom have already been known to the art in view of the disclosures such as of U.S. Pat. No. 3,003,805 and No. 3,633,962 and Japanese Patent Public Disclosure No. SHO 52(1977)-152397.

Such conventional bottle carriers are made of plastic materials. They are invariably designed to enable the bottles to be supported and held by the necks through effective use of the elasticity and recovering property of plastic materials. One common requirement to be fulfilled by all of them is that their retaining parts should be formed in an annular or curved shape having a diameter equal to or slightly smaller than the outside diameter of the necks of bottles so that the attachment of the carriers to the bottles is accomplished by having the retaining parts spread out radially enough to be slid past the brims of the bottles and, after passage over the brims, allowed to tighten themselves around the necks of bottles enough to combine the bottles into one portable bundle.

These conventional bottle carriers are provided with a certain degree of rigidity in order that they may allow the bottles to be carried as suspended securely from the aforementioned retaining parts which are wrapped around the necks of bottles. During the attachment of these carriers to the bottles, therefore, the retaining parts cannot be brought into contact with the necks of bottles unless they are spread out with considerably large strength. Conversely, during the detachment of these carriers from the bottles, because of the special design consideration paid to the prevention of accidental fall of bottles from the retaining parts while the bottles are in transit, the bottles will not readily come off the carriers unless they are pulled with much greater strength.

Generally, the bottle carriers of the construction described above are used more often than not be being provisionally mounted on the bottles at the time the bottles are packaged for shipment from the factory. Actually, this mounting work is carried out by mechanical means. The strength which is required in the attachment of the carriers to the bottles, therefore, does not matter much. Since the removal of the carriers from the bundled bottles is effected manually be consumers, however, great strength is required on the part of consumers. This inevitable exertion of strength renders the actual use of these conventional bottle carriers extremely inconvenient.

SUMMARY OF THE INVENTION

One object of this invention is to provide a bottle carrier capable of being attached to bottles without requiring much strength and also capable of being detached from the bottles without necessitating the great strength required in the case of the conventional bottle carriers and further capable of being detached intact from the bottles and therefore put to re-use.

Another object of this invention is to provide a bottle carrier adapted to interpose a separator between the two bottles so as to prevent the bottles from colliding with each other and consequently inflicting breakage upon each other.

Still another object of this invention is to provide a bottle carrier which is designed to have its component parts such as main carrier body, retaining parts, legs and separators all shaped in one substantially flat piece and, therefore, can be easily molded with a plastic material.

To attain the objects described above according to the present invention, there is provided a plastic bottle carrier comprising a main carrier body substantially of the shape of a plate, retaining parts each formed of a pair of opposed arms and extended outwardly from the corners of the longitudinal edges of the main carrier body, legs extended from the opposite longitudinal edges of the main carrier body and allowed to thrust out through spaces intervening between the opposed leading ends of the respective arms, and separators formed one each at the tips of the legs, with all the aforementioned component parts formed within one substantially flat plate, the retaining parts having the leading portions of the respective arms bent arcuately in the backward direction to give rise to engaging pieces, the legs having the respective basal portions formed in a decreased wall thickness to give rise to hinge portions.

The other objects and characteristic features of the present invention will become apparent from a disclosure to be given in detail hereinafter with reference to the accompanying drawing.

DETAILED DESCRIPTION OF PREFERRED EMBODIMENT

Figure 1:
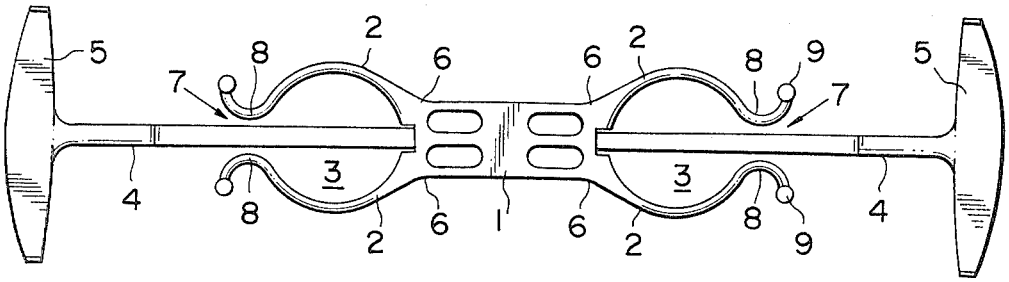
FIG. 1 is a plan view of a bottle carrier according to the present invention.

The bottle carrier illustrated herein comprises a main carrier body 1 of the shape of a substantially rectangular oblong plate, two retaining parts 3, 3 disposed one each on the opposite longitudinal edges of the main carrier body and each formed of a pair of inwardly arcuate arms 2, 2, legs 4, 4 extended outwardly at right angles from the central portions of the opposite edges of the main carrier body, and separators 5, 5 joined one each to the leading ends of the legs in the shape of the letter "T" and possessed of an arcuate cross section.

The retaining parts 3, 3 have the pairs of arms 2, 2 extending from the opposite corners 6 of the longitudinal edge of the main carrier body so that the retaining parts thus formed of the pairs of arms 2, 2 are circularly bent. The leading ends of each pair of arms 2, 2 are opposed to each other across a space 7 and are arcuately curved in the direction opposite the direction of the curve of their respective main portions of the arms to give rise to engaging pieces 8, 8. At the tips of these engaging pieces 8, 8, short cylindrical hooks 9, 9 are integrally formed. The arms 2, 2 are reinforced by causing ribs 10, 10 formed protrudingly from the lower surfaces of the lateral edges of the main carrier body 1 to be outwardly extended past the bases of the arms halfway along the entire lengths of the arms. Consequently, the arms enjoy a high self-retaining property as far as they are supported by the extended ribs and offer desirable flexibility where they are no longer supported by the ribs.

The legs 4, 4 which are extended from the central portions of the opposite longitudinal edges of the main carrier body 1 thrust away from the main carrier body 1 in the opposite directions, pass through the spaces 7 intervening between the leading ends of the arms 2, 2 and terminate in the two separators 5, 5 provided at the leading ends thereof and disposed parallelly to each other.

The basal end portions of the legs 4, 4 which continue into the opposite longitudinal edges of the main carrier body are formed with a decreased wall thickness so as to form hinge portions 11. Over a short distance from the hinge portions toward the respective leading ends, the legs 4, 4 are formed in a slightly increased wall thickness so as to form flexible portions 12. Consequently, the legs 4 can be freely folded about the hinge portions 11 as the fulcrums relative to the main carrier body 1 and, at the same time, freely bent in the flexible portions 12.

Figure 2:
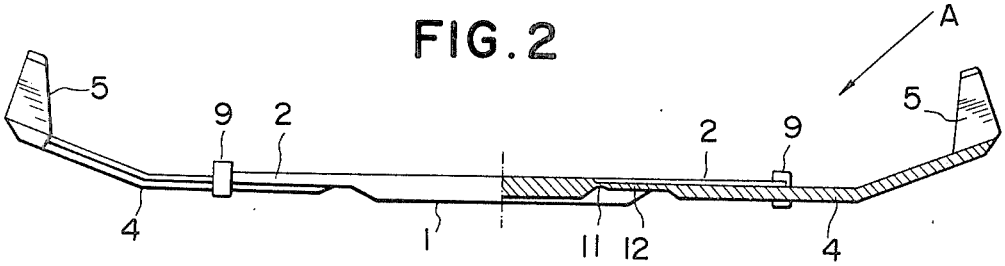
FIG. 2 is a front view of the bottle carrier of FIG. 1, with the righthand half of the bottle carrier sectioned longitudinally along the center line.
Figure 3:
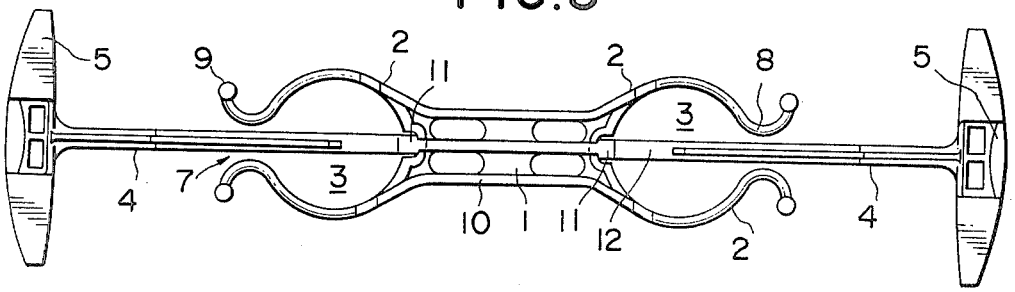
FIG. 3 is a bottom view of the bottle carrier of FIG. 1.
Figure 4:
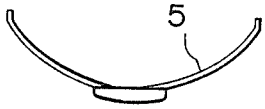
FIG. 4 is a side view of the separators as observed in the direction of the arrow "A" indicated in FIG. 2.

The bottle carrier of the construction described above is integrally molded with a thermoplastic synthetic resin possessing both rigidity and flexibility in suitable balance in a pattern such that the main carrier body 1 is disposed at the center and the retaining parts 3, 3 each formed of a pair of arms 2, 2 and legs 4, 4 are disposed symmetrically relative to the main carrier body and all these component parts are arranged so as to form one substantially flat piece as illustrated in FIGS. 1–3.

Figure 5:
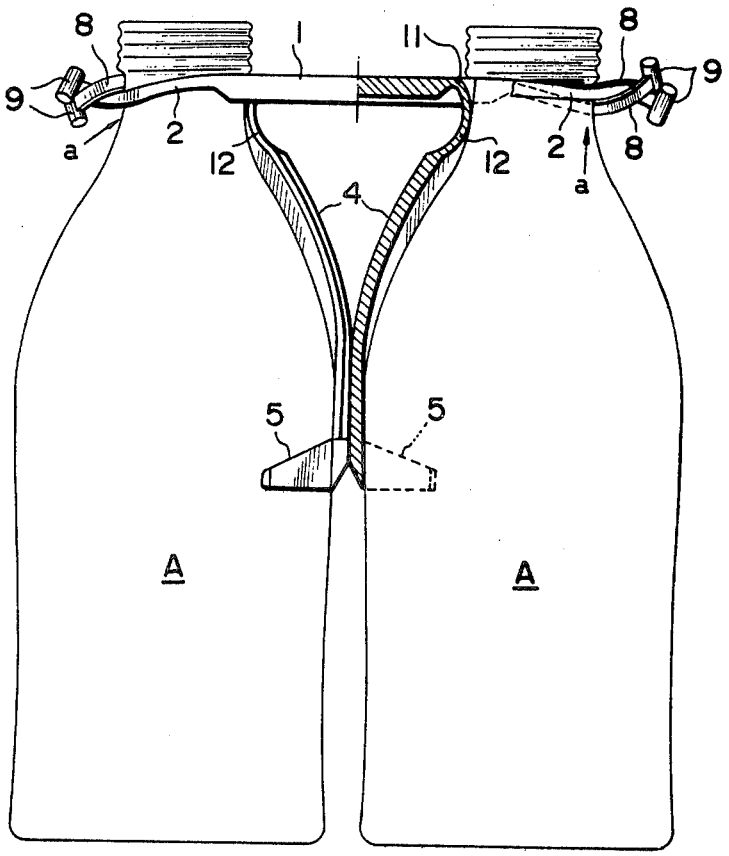
FIG. 5 is a front view illustrating the condition in which the bottle carrier is put to use, with the righthand half of the bottle carrier sectioned.
Figure 6:
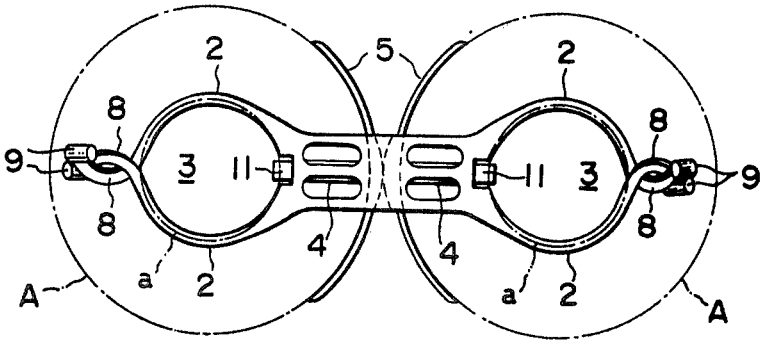
FIG. 6 is a plan view of the bottle carrier illustrated in FIG. 5.

FIG. 5 and FIG. 6 are explanatory diagrams illustrating the condition in which the bottle carrier of the aforementioned construction is used to support two bottles A, A. Now, the actual condition in which the bottle carrier is put to use will be described with reference to the diagrams. The attachment of this bottle carrier to the bottles is accomplished by pushing open the leading ends of the arcuate arms 2, 2 of the retaining parts 3 to enlarge the spaces 7, wedging the neck portions a of the bottles A into the gaps between the arms 2, 2 and, after the neck portions a have been received to the centers of the retaining parts 3, allowing the spaces separating the leading ends of the arms to resume their original size by virtue of the resilience of the material used and then causing the engaging pieces 8, 8 formed at the tips of the arms 2, 2 to be twisted around each other thereby enabling the arms to embrace tightly the neck portions a of the bottles. The work described above is performed on each of the opposite retaining parts, whereby the neck portions a of the bottles are embraced in position by the respective parts 3, 3 and, as a result, the two bottles A, A are joined in a parallelly arranged state as illustrated in the diagrams. In the course of this attachment of the bottle carrier, specifically at the time that the neck portions a of the bottles are swedged into the gaps in the retaining parts 3, the legs 4, 4 are folded downwardly about the hinge portions 11 and the flexible portions 12 until the separators 5, 5 provided at the leading portions of the legs are laid along the barrel portions of the bottles and interposed between the opposed surfaces of the bottles A, A which are joined to each other in a parallelly arranged state as illustrated.

According to the present invention, therefore, the attachment of the bottle carrier to the bottles is accomplished by inserting the neck portions of the bottles into the gaps between the pairs of arms 2, 2 in the retaining parts and twisting the engaging pieces 8, 8 at the tips of the arms around each other thereby binding the arms. Thus, the attachment can be carried out very easily without entailing the great strength which is inevitably required by the conventional bottle carriers in causing their retaining parts to be pushed open and slid past the brims of bottles. The detachment of the bottle carrier from the bottles is effected simply by relieving the engaging pieces 8, 8 of their mutual twist. Besides, the twisting and the untwisting of the engaging pieces 8, 8 can be effected by use of a thumb and an index finger. Thus, the detachment is accomplished with great ease without having to pull the bottles forcibly from the bottle carrier. Since the bottle carrier is not damaged during its attachment to or detachment from the bottles, it can be used again. Incidentally, since mutual engagement of the arms 2, 2 is effected by causing their respective engaging pieces 8, 8 to be hooked on each other, the tightening force exerted by the arms in themselves has virtually no effect on this mutual engagement. Thus, the arms call for no special consideration as to the springiness and rigidity otherwise required in the retention of bottles. Instead the engaging pieces 8, 8 formed at the leading ends of the arms are required to possess engaging and retaining force great enough for the bottles and their contents to be suspended safely from the arms. By this reason, in the embodiment described above, the engaging pieces 8 including part of their respective arms have a square cross section so that they are effectively hooked on each other when they are brought into mutual engagement. Besides, the hooks 9 formed at the tips of the arms add greatly to the tightness with which the engaging pieces are hooked on each other and prevent the bound engaging pieces from being accidentally undone upon exposure to external shocks. The paired arms 2, 2 which go to make up the retaining parts have a length such that when they are bound as described above, they form a ring of a diameter virtually equal to the outside diameter of the neck portions a of the bottles and, consequently, the bound arms are held in tight contact with the outer surfaces of the neck portions and allowed to keep the neck portions from freely slipping off the arms.

Further, the bottle carrier of the present invention is adapted to interpose the separators between the bottles embraced in the retaining parts thereby keeping the bottles from directly colliding with each other. Thus, it serves the purpose of effectively preventing the bottles from sustaining breakage due to their mutual collision in transit and permitting the bundled bottles to be carried around safely.

Moreover, since the bottle carrier of this invention is shaped in a construction having the main carrier body disposed at the center and all the component parts arranged in the form of one substantially flat plate, it enjoys the advantage that it can be easily molded with a plastic material and offered at a low cost.

The embodiment described above is provided with two legs extending outwardly from the opposite longitudinal edges of the main carrier body. Optionally, either of the two legs may be omitted. In the embodiment involving this omission, since one separator is available for interposition between the two bottles, the aforementioned effect that the bottles are prevented from colliding with each other can be obtained similarly.

What is claimed is:

1. A bottle carrier, which comprises a main carrier body substantially of the shape of a plate, retaining parts each formed of a pair of opposed arms and extended outwardly from the corners of the longitudinal edges of said main carrier body, legs extended from the opposite longitudinal edges of said main carrier body and allowed to thrust out through spaces intervening between the opposed leading ends of the respective arms, and separators formed one each at the tips of the legs, with all the aforementioned component parts formed within one substantially flat plate, said retaining parts having the leading portions of the respective arms bent arcuately in the backward direction to give rise to engaging pieces, said legs having the respective basal portions formed in a decreased wall thickness to give rise to hinge portions which allow said legs to be folded downwardly and said separators at the leading ends of said legs to be brought into contact with the barrel portions of bottles, and said parts of opposed arms of said retaining parts being adapted to be wrapped around the neck portions of the bottles and fastened thereto by having said engaging pieces thereof twisted around each other to bind the bottles to each other.

* * * * *